United States Patent [19]

Fornasari

[11] Patent Number: 4,877,049

[45] Date of Patent: Oct. 31, 1989

[54] PNEUMATIC, WATER LEAKAGE SAFETY DEVICE FOR WASHING MACHINES

[75] Inventor: Paolo Fornasari, Alessandria, Italy

[73] Assignee: Eltek, S.p.A., Alessandria, Italy

[21] Appl. No.: 259,362

[22] Filed: Oct. 14, 1988

[30] Foreign Application Priority Data

Oct. 23, 1987 [IT] Italy ..... 67883-A/87

[51] Int. Cl.[4] ..... F16K 31/122; F16K 31/126; F16K 33/00; H01H 35/18

[52] U.S. Cl. ..... 137/312; 200/61.04; 200/61.2; 200/83 WM; 200/84 R; 68/207; 137/387; 137/429

[58] Field of Search ..... 68/207; 134/157 R, 157 D; 137/312, 387, 412, 413, 429; 200/61.04, 61.2, 83 WM, 84 R

[56] References Cited

U.S. PATENT DOCUMENTS

| | | | |
|---|---|---|---|
| 2,885,879 | 5/1959 | Bloom | 68/207 |
| 3,334,651 | 8/1967 | Clearman | 137/387 |
| 3,344,804 | 10/1967 | Lyman | 68/207 |
| 3,464,437 | 9/1969 | Zane | 137/387 |
| 3,770,002 | 11/1973 | Brown | 137/312 |
| 4,180,095 | 12/1979 | Woolley et al. | 68/207 |
| 4,201,240 | 5/1980 | Case | 68/207 |
| 4,305,420 | 12/1981 | Nussdorf | 200/61.04 |
| 4,418,712 | 12/1983 | Braley | 200/61.04 |

*Primary Examiner*—George L. Walton
*Attorney, Agent, or Firm*—Browdy and Neimark

[57] ABSTRACT

A pneumatic safety device designed to prevent water leakage caused by failure of any washing machine component. Said device comprises one or two pneumatically-actuated valves positioned downstream from the machine's water supply faucet. When said machine is being filled with water a small electric pump generates compressed air that opens the water inlet valve(s) against the reaction of springs. A float associated with an electric switch, normally closed when the machine is operating, rises when water leaks occur opening said switch, which shuts off the machine and pump power, and also closes the water intake valve(s).

9 Claims, 2 Drawing Sheets

PNEUMATIC, WATER LEAKAGE SAFETY DEVICE FOR WASHING MACHINES

DESCRIPTION

Known devices protecting against flooding owing to washing machine malfunctions generally comprise one or two solenoid valves connected electrically in series to a microswitch, which is governed by float. The leaking water causes the float to rise triggering the microswitch which closes the solenoid valve(s) shutting off the water entering the machine.

The above, and other known systems, have the advantage of using low-cost supply hoses considering said hoses need not handle high water pressures, but the structure of the solenoids must meet high safety standards because they are in the immediate vicinity of the faucets, and have to be fully electrically insulated to safeguard the operator from high-voltage shocks.

The principal objective of the present invention is to eliminate the solenoid valve(s) located downstream from the water inlet and the danger of electric shocks by replacing said valve(s) with pneumatically-actuated valve(s).

Another objective of the present invention is to create a pneumatic device that can both cut off the power supply to the compressed air pump, which opens and closes the valve(s), and shut off, if so desired, the washing machine automatically eliminating hazards for the operator.

Yet another objective of the present invention is to limit the cost of said device enabling it to be used on all washing machines.

Considering the objectives described, the present invention relates to a pneumatic device that includes one or two pneumatically-actuated valves installed directly downstream of the washing machine water supply faucet. Said normally-closed valves are opened against the reaction of calibrated springs by the air pressure generated by a small electric vibrator pump connected to an electric circuit that also includes a microswitch associated with a float, which rises owing to water leaks opening said microswitch shutting off the power supply circuit of the pump and, if desired, the washing machine. The water supply valves close when the pump ceases to operate preventing flooding, while the electrically-isolated washing machine shuts off.

The machine can be turned on again after emptying the tray that collects the water.

The invention may be better understood from a reading of the following detailed description in conjunction with the drawings in which like reference designations indicate like parts and in which.

Figure 1:
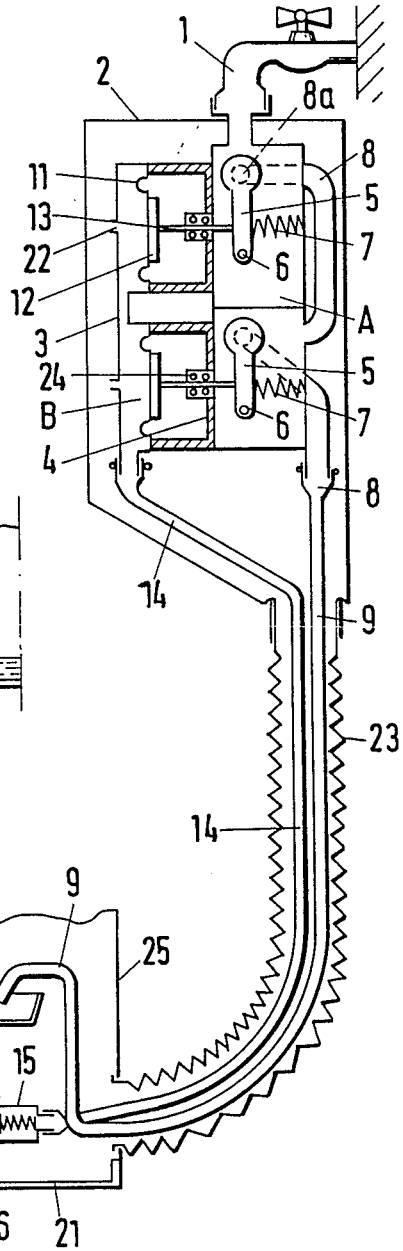
FIG. 1 is a vertical cross section illustrating the device installed at the base of any washing machine, dishwasher, or any other industrial washing device.
Figure 5:
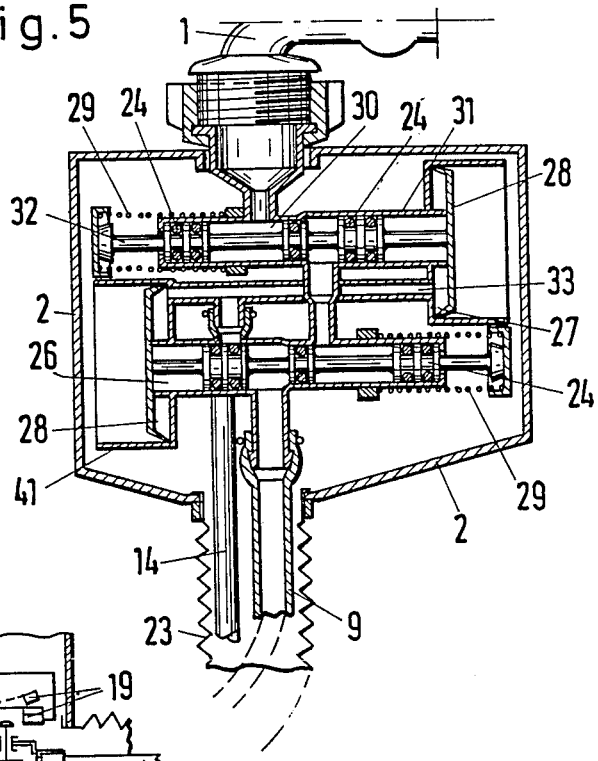
Figure 6:
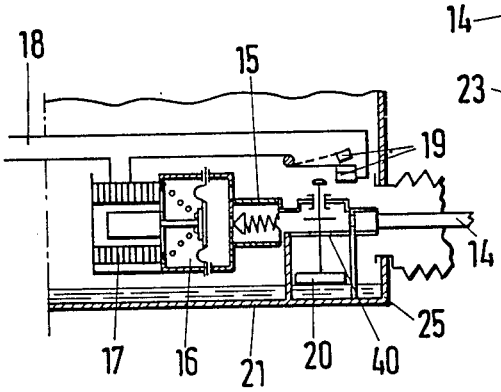
Figure 7:
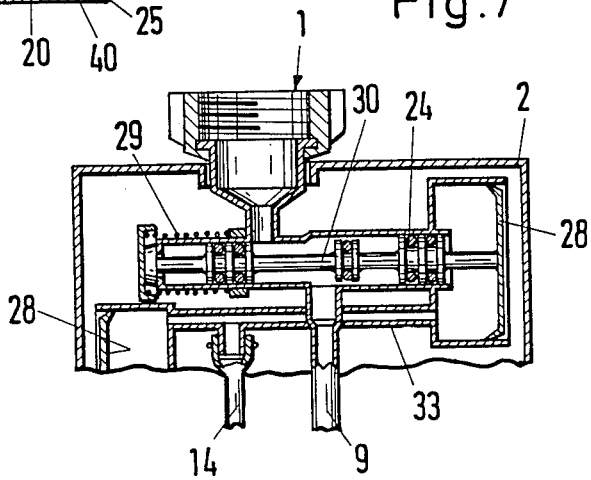

FIG. 5, similar to FIG. 1, illustrates the housing of the preferred structure of a valve included in the device;

FIG. 6 is a schematic drawing of the pump and microswitch associated with the float;

FIG. 7 illustrates the valve of FIG. 5 in a different position.

Figure 2:
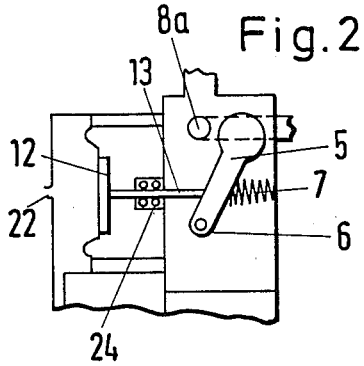
FIG. 2 illustrates component parts of the device of FIG. 1.

Referring to FIGS. 1–4, the device includes a body 2 directly connected to a faucet 1. Said body 2 contains lining 3, divided by a wall 4 into two chambers -A- and -B-. Chamber -A- contains two slide valves 5 connected to faucet 1. The bodies of the valves 5 are made of polytetrafluorethylene. Valves 5 pivot at 6, and can only rotate in a clockwise fashion, with reference to the drawing, against the reaction of springs. 8 indicates the couplings between chamber -A- and line 9, which empties into tub 10. Chamber -B- includes two elastic (elastomeric) membranes 11 with central rigid plate 12 integral with shaft 13 able to actuate corresponding valve 5 in an angular fashion (FIG. 2). Seals 24, which can be two O-rings, create a sealed passage for the movement of shafts 13 integral with plates 12. -B- indicates an air chamber which, by means of tube 14, is connected to valve 15 of a small electric vibrator pump 16 and a solenoid 17, which in turn is connected to a circuit 18 supplying electrical power. Said circuit also comprises a N/C switch, which can be opened by the upward movement transmitted by float 20 contained in a recess communicating with the inside of tray 21 which is situated inside the washing machine's metal housing in such a way as to collect water leaks. Calibrated passages 22 (FIG. 1) are located in lining 3 for the purpose hereinunder described. 23 indicates the corrugated sheath containing and protecting the tubular lines for water 9 and compressed air 14. Said sheath is not subjected to pressure and therefore does not have a pressure-resistant structure.

OPERATION OF THE DEVICE

Figure 3:
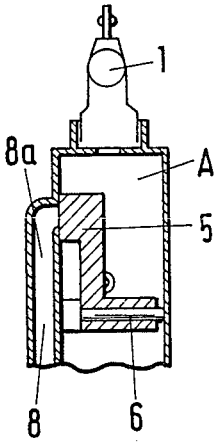
FIG. 3 is the cross section of one of the valves of the device of FIG. 1.

When the washing machine is not operating valves 5 are in the closed position indicated in FIGS. 1 and 3. The water from faucet 1 cannot flow past chamber -A- because valves 5 intercept passages 8a connected to couplings 8 and supply hose 9. Under these conditions, no water enters tub 10. When the machine cycle is begun by means of its timer vibrator pump 16,17 starts to operate generating compressed air which passes through line 14 compressing plates 12 against the reaction of springs 7, moving valves 5 to the position shown in FIG. 2, and opening passages 8*a*, through which the water flows into chamber -A-, and then entering hose 9 which supplies water to the washing machine tub 10. Pump 16,17, controlled by the washing machine timer, is actuated and remains operative during all phases of water supply to tub 10.

Figure 4:
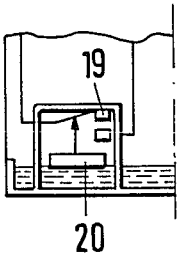
FIG. 4 illustrates a float associated with a microswitch.
Figure 4:
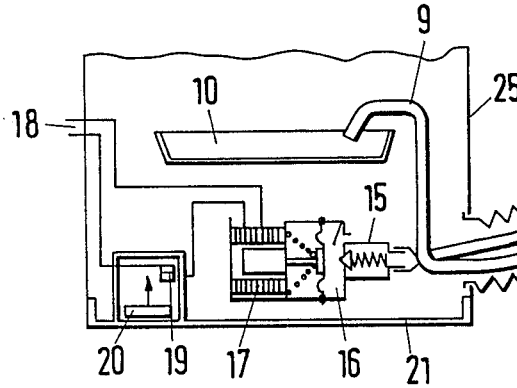

If losses were to occur, generated by malfunctions of various nature or failure of machine component parts, the water would collect in tray 21 under float 20 causing it to rise, which opens, as shown in FIG. 4, switch 19 interrupting the power supply to the machine and pump 16,17, or can interrupt only the circuit powering said pump.

When pump 16,17 stops operating, the air pressure in chamber -B- slowly drops thanks to calibrated passages 22. The reaction of springs 7 brings valves 5 into such a position as to close passages 8*a* without causing "water hammer" to occur in the pipes; said effect is prevented by the gradual closing of valves 5 with respect to passages 8a.

After locating and eliminating the malfunction and emptying tray 21, the machine can be turned on again. Calibrated passages 22 also allow excess compressed air pressure present in the system to be bled during operation of pump 16,17.

FIGS. 5–7 schematically illustrate a preferred structural variant of the device. The component parts identical or equivalent to those parts illustrated in FIGS. 1–4 have the same reference numbers.

With reference to FIG. 5, the water supplied from faucet 1 flows into passage 30, defined by pistons with dual O-ring seals 24; said pistons move in cylinder 31. Under these conditions, the water cannot go further than passage 30 when the washing machine is not operating.

When the machine is operating, electric pump 16,17 generates compressed air which, through valve 15, tubular line 14, and tubular coupling 33, enters cylinders 26,27 acting on adjacent flat pistons 28 causing the different component parts to move into the position illustrated in FIG. 7, overcoming the force exerted by springs 29. Under these latter conditions, water entering at 1 flows through tubular line 9 entering wash tub 10 (FIG. 1).

Water leaking, owing to machine malfunctions, collects in tray 21 under float 20 pushing it upwards opening electrical switch 19 which results in the machine being shut off.

As illustrated in FIG. 6, the upwards movement of float 20 also opens valve 40 when opening switch 19. The air pressure present in the pump circuit and the water inlet valves immediately drops allowing the valves to close thanks to springs 29. In this case as well, no "water hammer" effects are created.

The emptying of tray 21 and repair of the malfunctioning component parts allow the reactivation of the industrial or domestic washing machine.

The above description clearly illustrates the characteristics and advantages of utilizing the device which can be summarized as follows.

Immediate closing of the washing machine water supply valves owing to water leakage causing switch 19 and valve 40 to open. Opening of the latter component bleeds the compressed air present allowing a rapid closing of said water supply valves without "water hammer".

Elimination of solenoid valves near the water supply faucet preventing possible hazards for the machine's operator.

Considerable saving of manufacturing costs by elimination of said solenoid valves.

Simple structural design resulting in functional reliability of the device.

Small dimensions allowing the device to be included in small assemblies.

The invention is not limited to the examples described and schematically illustrated, but includes any other solution, analogous or equivalent having the same object in which the device utilizes compressed air for governing water shut-off valves in lieu of solenoid valves; said device is designed for use in domestic and/or industrial washing machines.

What is claimed is:

1. A pneumatic, water leakage safety device designed for domestic and/or industrial washing machines having a housing containing at least one pneumatically-actuated valve controlling the entry of water into the tub of said washing machine; said at least one valve being actuated, power supply means; at least one calibrated spring which reacts against the movement of the at least one valve in response to the compressed air acting upon said at least one valve; an electric switch associated with a float being included in the power supply means of said pump; said float being positioned so as to rise due to the effect of leakage water collecting in a tray due to machine malfunctions; said float causing said switch to open shutting off the power supply to said pump and that of the washing machine.

2. A device as claimed in claim 1, in which said pump generating compressed air is a vibrator-type pump.

3. A device as claimed in claim 1, in which an elastic membrane means is elastically deformed due to the pressure created by the compressed air and is centrally integral with a plate comprising a rigid shaft capable of actuating said at least one valve against the reaction of the at least one claibrated spring.

4. A device as claimed in claim 1, in which the elastic membrane means and relative rigid plates are contained in a chamber whose walls include calibrated equilibratory passages for the outflow of compressed air.

5. A device as claimed in claim 1, wherein calibrated passages which connect the inside of said chamber with the external environment allow the gradual outflow of the compressed air present and the consequent gradual closing of the water supply valves preventing the creation of "water hammer" phenomena in the pipes when the washing machine is turned off.

6. A device as claimed in claim 1, in which the zone where the shafts move is sealed by a dual set of elastic O-ring-type seals.

7. A device as claimed in claim 1, in which the valves controlling the supply of water to the washing machine tub are slide valves normally closed due to the action of the calibrated springs.

8. A device as claimed in claim 1, in which said at least one valve is a piston valve and the compressed air generated by the electric pump acts against the reaction of the at least one calibrated spring on the piston valve whose piston is mounted in a mobile fashion in a communicating adjacent cylinder.

9. A device as claimed in claim 1, in which said at least one valve has a body which is made of polytetrafluorethylene.

* * * * *